United States Patent [19]

Terazawa

[11] Patent Number: 5,022,369

[45] Date of Patent: Jun. 11, 1991

[54] THROTTLE CONTROL APPARATUS

[75] Inventor: Tadashi Terazawa, Toyota, Japan

[73] Assignee: Aisin Seiki Kabushiki Kaisha, Kariya, Japan

[21] Appl. No.: 470,687

[22] Filed: Jan. 26, 1990

[30] Foreign Application Priority Data

Jan. 31, 1989 [JP] Japan ..... 1-022190

[51] Int. Cl.[5] ..... F02D 9/08

[52] U.S. Cl. ..... 123/399; 123/361

[58] Field of Search ..... 123/399, 361

[56] References Cited

U.S. PATENT DOCUMENTS

| | | | |
|---|---|---|---|
| 4,385,675 | 5/1983 | Blee | 123/361 |
| 4,703,823 | 11/1987 | Yogo et al. | 123/399 |
| 4,714,864 | 12/1987 | Yogo et al. | 123/361 |
| 4,809,656 | 3/1989 | Suzuki | 123/399 |
| 4,892,071 | 1/1990 | Asayama | 123/399 |

FOREIGN PATENT DOCUMENTS

| | | | |
|---|---|---|---|
| 55-145867 | 11/1980 | Japan . | |
| 0153945 | 9/1984 | Japan | 123/361 |

*Primary Examiner*—Tony M. Argenbright
*Assistant Examiner*—Robert E. Mates
*Attorney, Agent, or Firm*—Burns, Doane, Swecker & Mathis

[57] ABSTRACT

A throttle control apparatus for an internal combustion engine has a throttle opening and closing arrangement for opening and closing a throttle valve. The arrangement is biased in the throttle valve closing direction. An accelerator actuating mechanism, a driving element capable of driving the throttle opening and closing arrangement in the throttle valve opening and closing directions independently of the accelerator actuating mechanism, a driving source coupled to the driving element to drive it to rotate in response to the operation of the accelerator actuating mechanism, and a clutch for connecting and disconnecting the throttle opening and closing arrangement and the driving element. The throttle control apparatus includes a first detector for outputting a signal corresponding to the accelerator actuating quantity provided by the accelerator actuating mechanism, a second detector for outputting a signal corresponding to the degree of opening of the throttle valve, and a controller for driving the clutch to disconnect the throttle opening and closing arrangement and the driving element from each other when the output signal from the first detector indicates an accelerator actuating quantity not greater than a predetermined accelerator actuating quantity and the output signal from the second detector is a predetermined angle greater than the degree of opening of the throttle valve corresponding to the accelerator actuating quantity not greater than the predetermined accelerator actuating quantity.

5 Claims, 6 Drawing Sheets

THROTTLE CONTROL APPARATUS

BACKGROUND OF THE INVENTION

1. Field of the Invention

The present invention relates to a throttle control apparatus which is attached to an internal combustion engine. More particularly, the present invention pertains to a throttle control apparatus which is arranged to control the degree of opening of the throttle valve of an internal combustion engine by means of a driving source, for example, a motor, in accordance with the operation of the accelerator, thereby effecting various control operations such as acceleration slip control, constant-speed running control, idling control, automatic vehicle speed limiting control, fuel-saving running control, etc., and which is designed so that the control effected by the driving source can be suspended if necessary.

2. Description of the Related Art

The throttle valve of an internal combustion engine is arranged to control the output of the internal combustion engine by controlling the fuel-air mixture in a carburetor or the intake air quantity in an electronically controlled fuel injector in association with an accelerator actuating mechanism which includes an accelerator pedal.

The accelerator actuating mechanism has heretofore been mechanically coupled to the throttle valve, whereas there has recently been proposed an apparatus wherein the throttle valve is opened and closed in accordance with the operation of the accelerator by a driving means which is interlocked with a driving source, for example, a motor. For example, Japanese Patent Laid-Open Publication (KOKAI) No. 55-145867 (1980) discloses an apparatus wherein a stepping motor is coupled to the throttle valve and driven in accordance with the operation of the accelerator pedal.

Japanese Patent Laid-Open Publication (KOKAI) No. 59-153945 (1984) lists examples of the countermeasures which have heretofore been taken when an electronically controlled actuator that drives the stepping motor falls into an uncontrollable situation in an apparatus of the type disclosed in Japanese Patent Laid-Open Publication (KOKAI) No. 55-145867 (1980). For example, the throttle shaft is disengaged from the electronically controlled actuator by means of an electromagnetic clutch and the throttle valve is returned to the closed position by means of a return spring. The same publication states that the prior art listed therein has no driving means for opening and closing the throttle valve after the control by the electronically controlled actuator has stopped and therefore is incapable of permitting the vehicle to be moved to a given place for repair, and proposes a solution to the problem.

Specifically, the proposed solution comprises an electromagnetic clutch interposed between a rotary shaft which rotates in response to the driver stepping on the accelerator so that, when excited, it disconnects the two shafts, whereas, when not excited, it connects them together. A control circuit drives a relay when detecting an abnormality of the control operation effected by the electronically controlled actuator to cut off the supply of power to the actuator and the electromagnetic clutch. Accordingly, when the electronically controlled actuator falls into an uncontrollable situation, the throttle shaft is mechanically coupled to the accelerator pedal through the electromagnetic clutch.

According to the technique disclosed in the above-described Japanese Patent Laid-Open Publication (KOKAI) No. 59-153945 (1984), the fact that the electronically controlled actuator is in an uncontrollable state is detected by another control circuit and the supply of power to the actuator and the electromagnetic clutch is suspended by this control circuit. After the control operation has been suspended, the throttle shaft and the rotary shaft that is mechanically coupled to the accelerator pedal are connected together through the electromagnetic clutch. The electromagnetic clutch is maintained in the state wherein it is coupled to the actuator even after the throttle shaft has been mechanically coupled to the accelerator pedal through the electromagnetic clutch. In the description of operation of one embodiment when the electronically controlled actuator suspends its control operation, no driving torque is generated from the motor and therefore the resistance to the accelerator stepping force is so small that there is no hindrance to the operation of opening and closing the throttle valve as effected by the driver stepping on the accelerator pedal.

However, the electromagnetic clutch that is used in such prior apparatus is structurally large and high in cost. Further, possibilities exist that not only the electronically controlled actuator will become uncontrollable but also the control circuit will become unable to operate. For example, there is a possibility that the throttle valve could be continuously driven to the open side by electrical pulses or the like. In such a case, even if a switching means is provided to suspend the supply of power to the electromagnetic clutch and couple the throttle shaft to the accelerator pedal, there is no means for activating the throttle valve to the closed side against the throttle shaft that is driven by the actuator and it is therefore difficult to ensure the desired throttle opening.

When the above-described situation occurs, the driver generally stops actuating the accelerator and applies the brakes. In the arrangement described above, however, the throttle valve continues being driven by the actuator unless the electromagnetic clutch is de-energized.

SUMMARY OF THE INVENTION

Under the foregoing circumstances, it is a primary object of the present invention to provide a throttle control apparatus which is designed so that, when suspension of the accelerator actuating operation is detected due to occurrence of an abnormality in a throttle valve driving means, for example, the above-described electronically controlled actuator, and it is detected when a predetermined throttle opening is exceeded, the driving means can be positively disengaged from the throttle valve.

To this end, the present invention provides a throttle control apparatus having throttle opening and closing means for opening and closing a throttle valve, biasing means for biasing the throttle opening and closing means in the throttle valve closing direction, an accelerator actuating mechanism, driving means capable of driving the throttle opening and closing means in the throttle valve opening and closing directions independently of the accelerator actuating mechanism, a driving source coupled to the driving means to drive it to rotate in response to the operation of the accelerator actuating mechanism, and clutch means for connecting and disconnecting the throttle opening and closing means and the driving means. The invention further includes first detecting means for outputting a signal corresponding to the degree of accelerator actuation provided by the accelerator actuating mechanism; second detecting means for outputting a signal corresponding to the degree of opening of the throttle valve; and control means for driving the clutch means to disconnect the throttle opening and closing means and the driving means from each other when the output signal from the first detecting means indicates a degree of accelerator actuation not greater than a predetermined degree of accelerator actuation and the output signal from the second detecting means is a predetermined angle greater than the degree of opening of the throttle valve corresponding to the degree of accelerator actuation which is not greater than the predetermined degree of accelerator actuation.

The throttle control apparatus also includes a second driving means disposed so as to be engagable with the throttle opening and closing means in the throttle valve opening direction and coupled to the accelerator actuating mechanism to drive the throttle opening and closing means to rotate in response to the accelerator actuating operation and the second driving means rotates independently of the driving means. The first detecting means preferably outputs a signal corresponding to the angle of rotation of the second driving means.

The arrangement may be such that the electromagnetic clutch mechanism and the first and second detecting means includes a limit switch so that the supply of electric power to the electromagnetic mechanism is controlled ON or OFF in response to the operation of the limit switch.

The arrangement may also be such that the electromagnetic clutch mechanism, the first and second detecting means comprises analog sensors, and a switching means is provided for the ON/OFF control of the supply of electric power to the electromagnetic clutch mechanism in response to the outputs from the analog sensors.

The throttle control apparatus, as described above, is connected to an internal combustion engine. In an initial position where the accelerator actuating mechanism is in a predetermined inoperative position, the throttle opening and closing means and the driving means are separate from each other. As the internal combustion engine is started, the throttle opening and closing means and the driving means are connected together by the clutch means so as to be able to rotate together in one unit. Thus, the driving means is driven to rotate by the driving source in response to the operation of the accelerator actuating mechanism, thereby controlling the degree of opening of the throttle valve through the throttle opening and closing means.

In this state, it is also possible to open and close the throttle valve by rotating the driving means while controlling the driving source independently of the accelerator actuating mechanism. Thus, by properly controlling the driving source, various control operations such as acceleration slip control, constant-speed running control, etc. are effected.

If the throttle valve is driven in the direction in which it opens due to an abnormal operation of the driving source or the like and consequently an acceleration which is higher than the level of the driver's expectation or a sudden start of the vehicle occurs, the accelerator actuating mechanism is brought into an inoperative state by releasing the accelerator pedal or returning it to a position where it is only slightly actuated. Thus, the output signal from the first detecting means will indicate a degree of accelerator actuation not greater than a predetermined accelerator actuating quantity. If, at this time, the output signal from the second detecting means is a predetermined angle greater than the degree of opening of the throttle valve corresponding to the degree of accelerator actuation which is not greater than the predetermined degree of accelerator actuation, the clutch means is driven by the control means to disconnect the throttle opening and closing means and the driving means. Thus, an abnormal throttle valve opening operation is avoided by bringing the accelerator actuating mechanism into an inoperative state.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements.

DETAILED DESCRIPTION OF THE PREFERRED EMBODIMENTS

Preferred embodiments of the throttle control apparatus according to the present invention will be described below with reference to the accompanying drawings.

Figure 1:
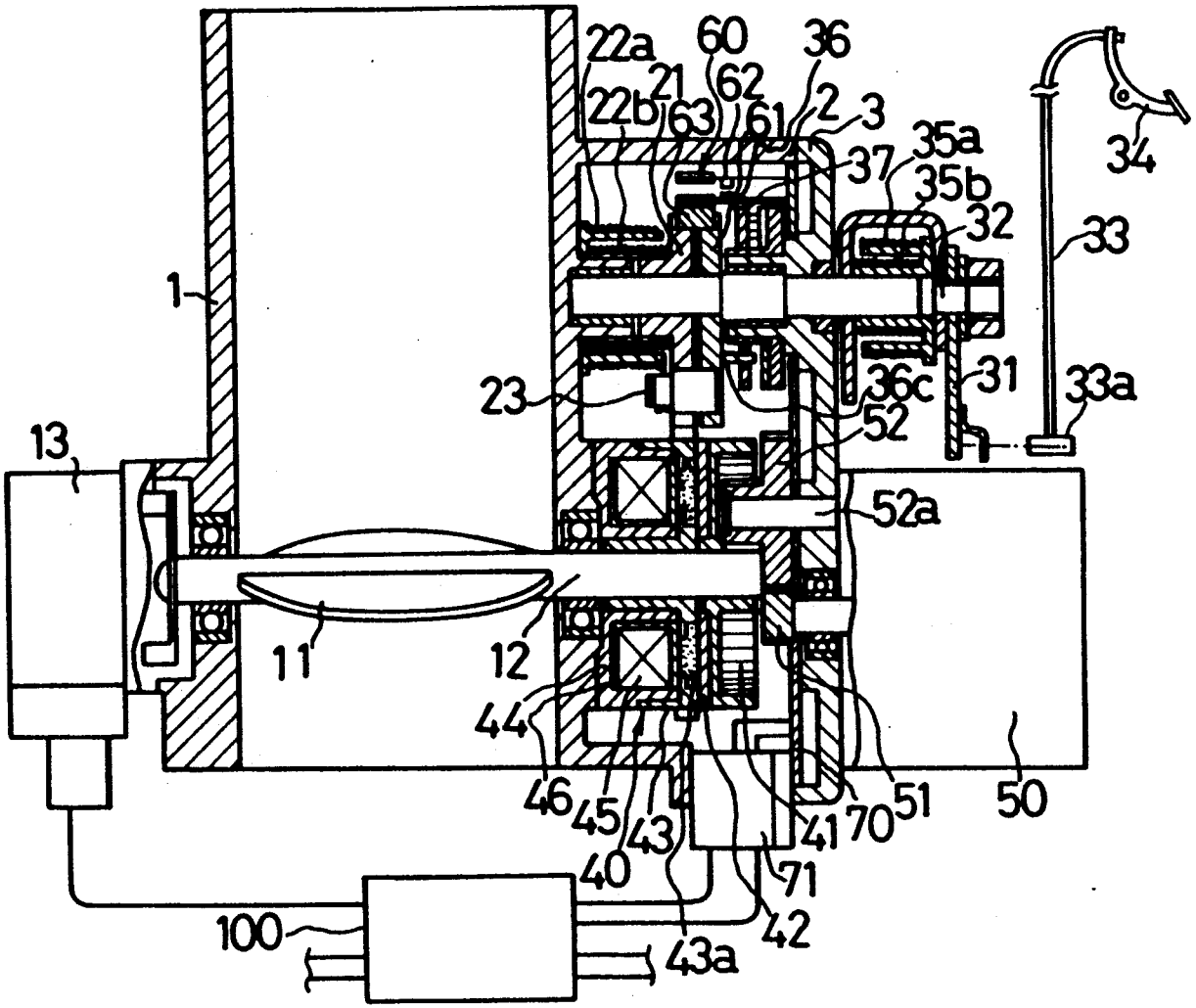
FIG. 1 is a vertical sectional view of one embodiment of the throttle control apparatus according to the present invention.

Referring first to FIG. 1, a throttle valve 11 is rotatably supported by a throttle shaft 12 inside an intake passage in a throttle body 1 of an internal combustion engine. A casing 2 is formed as being an integral part of the side of the throttle body 1 where one end of the throttle shaft 12 is supported, and a cover 3 is connected to the casing 2. Some of the parts constituting the throttle control apparatus of this embodiment are accommodated in the chamber defined by the throttle body 1, the casing 2 and the cover 3. A throttle sensor 13 is attached to the side of the throttle body 1 that is remote from the casing 2 and where the other end of the throttle shaft 12 is supported.

The throttle sensor 13, which has a detector for detecting the degree of opening of the throttle valve 11, is connected to the throttle shaft 12 to detect an angular displacement of the throttle shaft 12 and convert it into an electric signal. For example, an idling switching signal and a throttle opening signal are output to a controller 100. Thus, the flow rate of intake air supplied through the intake passage to a cylinder in an internal combustion engine equipped with an electronically controlled fuel injector (not shown) is controlled by the throttle valve 11 to thereby control the output of the internal combustion engine.

A movable yoke 43 is rigidly secured to the other end of the throttle shaft 12 so that the throttle valve 11 rotates together with the movable yoke 43 as one unit. The movable yoke 43 is a circular disc-like magnetic member having a shaft portion that is rigidly secured to the throttle shaft 12. The movable yoke 43 is fitted to a fixed yoke 44, which is a magnetic member having substantially the same configuration as that of the movable yoke 43, with a predetermined air gap provided therebetween in such a condition that the respective opening ends face each other and the respective side walls and shaft portions are axially superposed one upon another. The fixed yoke 44 is rigidly secured to the throttle body 1. A coil 45 that is wound around a bobbin 46 which is made of a non-magnetic material is accommodated in the space defined between the shaft portion and side wall of the fixed yoke 44. A friction member 43*a* which is an annular non-magnetic member is positioned in the bottom of the movable yoke 43 such that the friction member 43*a* is disposed around the throttle shaft 12. A driving plate 41 which serves as the driving means of the present invention is disposed so as to face the friction member 43*a* across a clutch plate 42 which is an annular magnetic member. Thus, these members constitute in combination an electromagnetic clutch mechanism 40.

The driving plate 41 is a circular dish-like member having a shaft portion in the center thereof, the shaft portion being supported on the throttle shaft 12 in such a manner as to be rotatable around it. The driving plate 41 has internal teeth formed on the inner periphery of the side wall thereof such that the internal teeth are meshed with the external teeth formed on the small-diameter portion of a gear 52 described later. The clutch plate 42 is coupled to the bottom surface of the driving plate 41 through a leaf spring (not shown). The clutch plate 42 is biased toward the driving plate 41 by the action of the leaf spring, so that the clutch plate 42 is kept separate from the movable yoke 43 when the coil 45 is not energized.

The gear 52 meshing with the driving plate 41 is a stepped columnar member having a small-diameter portion and a large-diameter portion which have respective external teeth, the gear 52 being supported by a shaft 52*a* rigidly secured to the cover 3 such that the gear 52 is rotatable around the shaft 52*a*. A motor 50 which serves as the driving source in the present invention is secured to the cover 3 such that the rotary shaft of the motor 50 extends parallel to the shaft 52*a* and is rotatably supported. A gear 51 is rigidly secured to the distal end of the rotary shaft of the motor 50, the gear 51 being meshed with the external teeth formed on the large-diameter portion of the gear 52. In this embodiment, a stepping motor is used as the motor 50 and the drive of the stepping motor is controlled by the controller 100. It should be noted that other types of motors, for example, a DC motor, may also be used as the motor 50.

Thus, when the motor 50 is driven to rotate the gear 51, the gear 52 rotates, and the driving plate 41, having internal teeth meshing with the gear 52 rotates around the throttle shaft 12, together with the clutch plate 42. If the coil 45 is not energized at this time, the clutch plate 42 is kept separate from the movable yoke 43 by means of the biasing force from the leaf spring. More specifically, in such a case, the movable yoke 43, the throttle shaft 12 and the throttle valve 11 are free to rotate independently of the driving plate 41. When the movable yoke 43 and the fixed yoke 44 are energized, the clutch plate 42 is attracted toward the movable yoke 43 by means of electromagnetic force against the biasing force of the leaf spring and eventually brought into contact with the movable yoke 43. Thus, the clutch plate 42 and the movable yoke 43 come into frictional engagement with each other. The frictional engagement and the action of the friction member 43*a* enable the clutch plate 42 and the movable yoke 43 to rotate together in the connected state. More specifically, in this case the driving plate 41, the clutch plate 42, the movable yoke 43, the throttle shaft 12 and the throttle valve 11 are driven to rotate together in one unit by the motor 50 driving through the gears 51 and 52.

An accelerator shaft 32 is rotatably supported by the throttle body 1 and the cover 3 in parallel to the throttle shaft 12, the outer end portion of the accelerator shaft 32 projecting from the cover 3. An accelerator link 31 which constitutes a rotary lever is secured to the projecting end portion of the accelerator shaft 32. A pin 33*a* which is rigidly secured to one end of an accelerator cable 33 is engaged with the distal end of the accelerator link 31. The accelerator link 31 has return springs 35*a* and 35*b* coupled thereto to bias both the accelerator link 31 and the accelerator shaft 32 in the direction in which the throttle valve 11 is closed. The other end of the accelerator cable 33 is coupled to an accelerator pedal 34, thus constituting an accelerator actuating mechanism in which both the accelerator link 31 and the accelerator shaft 32 rotate about the axis of the accelerator shaft 32 in response to the operation of the accelerator pedal 34.

An accelerator plate 36 is rigidly secured to the accelerator shaft 32 at the portion thereof that extends between the throttle body 1 and the cover 3, that is, inside the casing 2. A throttle plate 21 is rotatably supported by the accelerator shaft 32 in opposing relation to the accelerator plate 36.

Figure 2:
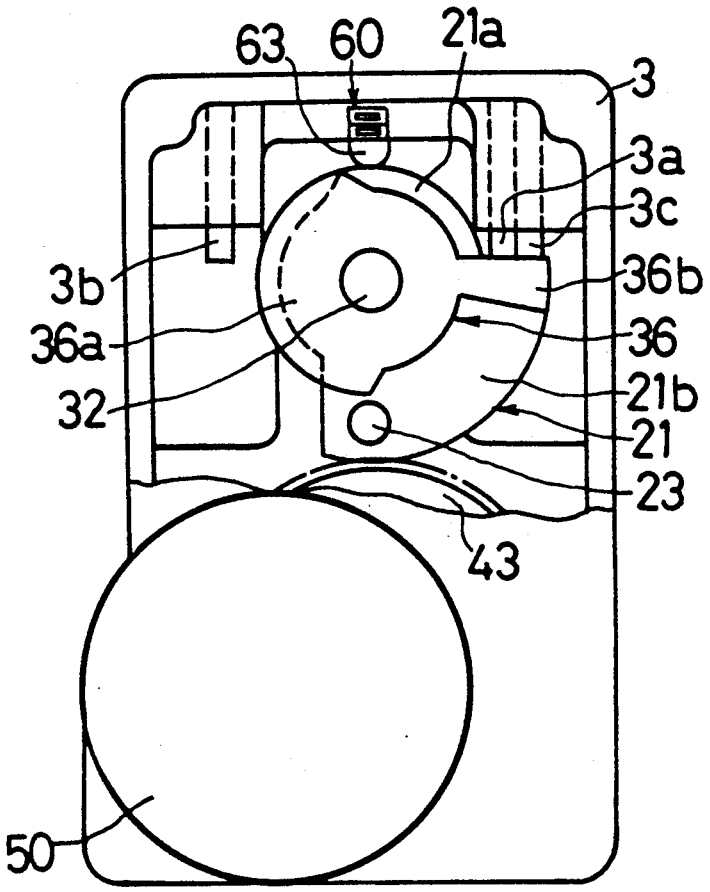
FIG. 2 is a partially-sectioned side view of the throttle control apparatus shown in FIG. 1.

The throttle plate 21 comprises, as center thereof by the accelerator shaft 32 and a sector portion 21*b* radially extending from the disc portion 21*a*, the sector portion 21*b* having external teeth formed on the outer surface thereof. The external teeth of the throttle plate 21 are meshed with the external teeth formed on the aforementioned movable yoke 43, so that the movable yoke 43 rotates in response to the rotation of the throttle plate 21 and the rotation of the yoke 43 causes rotation of the throttle shaft 12 and the throttle valve 11 that are connected thereto in one unit. Thus, the throttle plate 21 and the movable yoke 43 constitute in combination a throttle opening and closing means. As will be clear from FIG. 2, the throttle plate 21 is formed such that approximately a half of the outer peripheral portion of the disc portion 21*a* has a relatively long radius and the other portion has a relative short radius, thus defining an end cam along the outer peripheral surface of the disc portion 21*a*. The sector portion 21*b* is disposed such that one radially extending side surface thereof faces a stopper 3*a* provided on the cover 3 and the other side surface faces a stopper 3*b* similarly provided on the cover 3. These stoppers 3*a* and 3*b* regulate the rotation of the throttle plate 21. A pin 23 is secured to the sector portion 21*b* of the throttle plate 21 to retain one end of each of the return springs 22*a* and 22*b*, as shown in FIG. 1. Thus, the sector portion 21*b* is biased in a direction in which it abuts on the stopper 3*a* by means of the biasing force from the return springs 22*a* and 22*b*. That is, the throttle plate 21 is biased in the direction in which the throttle valve 11 is closed by the return springs 22*a* and 22*b* which serve as a biasing means. The accelerator plate 36 comprises, as shown in FIG. 2, a disc portion 36*a* rigidly secured at the center thereof to the accelerator shaft 32 and an arm portion 36*b* radially extending from the disc portion 36*a*, thus constituting a second driving means. The disc portion 36*a* is formed such that approximately a half thereof which is closer to the arm portion 36*b* has a relatively short radius and the other portion has a relatively long radius, thus defining an end cam by the outer peripheral surface of the disc portion 36*a*. The arm portion 36*b* is disposed such that one side surface that extends in the radial direction of the disc portion 36*a* faces a stopper 3*c* provided on the cover 3 and the other side surface faces the pin 23 provided on the throttle plate 21. Thus, when the accelerator plate 36 rotates clockwise as viewed in FIG. 2 and eventually the arm portion 36*b* abuts against the pin 23 on the throttle plate 21, the accelerator plate 36 and the throttle plate 21 rotate together in one unit.

The accelerator plate 36 is biased in a direction in which the arm portion 36*b* abuts against the stopper 3*c* by means of the biasing force from return springs 35*a* and 36*b* shown in FIG. 1. That is, the accelerator plate 36 and the throttle plate 21 shown in FIG. 1 are in their initial positions. When the driving plate 41 is connected to the movable yoke 43 by the electromagnetic clutch mechanism 40, the throttle valve 11 is driven to rotate by the motor 50. If the controller 100 or the motor 50 should break down, the driver depresses the accelerator pedal 34 more than a predetermined quantity, thereby bringing the arm portion 36*b* of the accelerator plate 36 into contact with the pin 23 on the throttle plate 21, and thus enabling the throttle valve 11 to be opened. It should be noted that an engagement projection 36*c* extends from the arm portion 36*b* in the axial direction of the accelerator shaft 32.

An acceleration sensor 37 is fitted on the outer periphery of an accelerator shaft bearing portion formed on the cover 3. The acceleration sensor 37 has a known structure which comprises a member formed with a thick film resistor and a brush which faces this member. The acceleration sensor 37 is disposed so that the brush is engaged with the engagement projection 36*c* provided on the accelerator plate 36. Thus, the angle of rotation of the accelerator shaft 32 that rotates together with the accelerator plate 36 in one unit is detected by the acceleration sensor 37. The acceleration sensor 37 is electrically connected to a printed circuit board 70 which is interposed between the casing 2 and the cover 3. The printed circuit board 70 is electrically connected to the controller 100, constituting a control means through a connector 71 which is rigidly secured to the casing 2.

The printed circuit board 70 has a limit switch 60 mechanically and electrically connected thereto which operates in association with the throttle plate 21 and the accelerator plate 36. The limit switch 60 has a pair of resilient reeds 61 and 62, respectively, having opposing contacts, and a sliding member 63 rigidly secured to the distal end portion of one reed 61. The sliding member 63 is biased by the resilient force from the reed 61 so as to abut on the outer peripheral surfaces of the throttle plate 21 and the accelerator plate 36, as will be clear from FIGS. 1 and 2. Accordingly, the sliding member 63 moves in accordance with the profiles of the end cams formed on the throttle plate 21 and the accelerator plate 36, so that the contact of the reed 61 comes in and out of contact with the contact of the reed 62 in response to the cam following action of the sliding member 63. The limit switch 60 and the accelerator plate 36 define the first detecting means while the limit switch 60 and the throttle plate 21 define the second detecting means. It should be noted that FIG. 1 shows the state wherein the sliding member 63 is disposed on the respective short radius portions of the throttle and accelerator plates 21 and 36 and, consequently, the opposing contacts of the reeds 61 and 62 are separate from each other, while FIG. 2 shows the state wherein the sliding member 63 is disposed on the respective long radius portions of the throttle and accelerator plates 21 and 36 and, consequently, the opposing contacts of the reeds 61 and 62 are in contact with each other.

Figure 3:
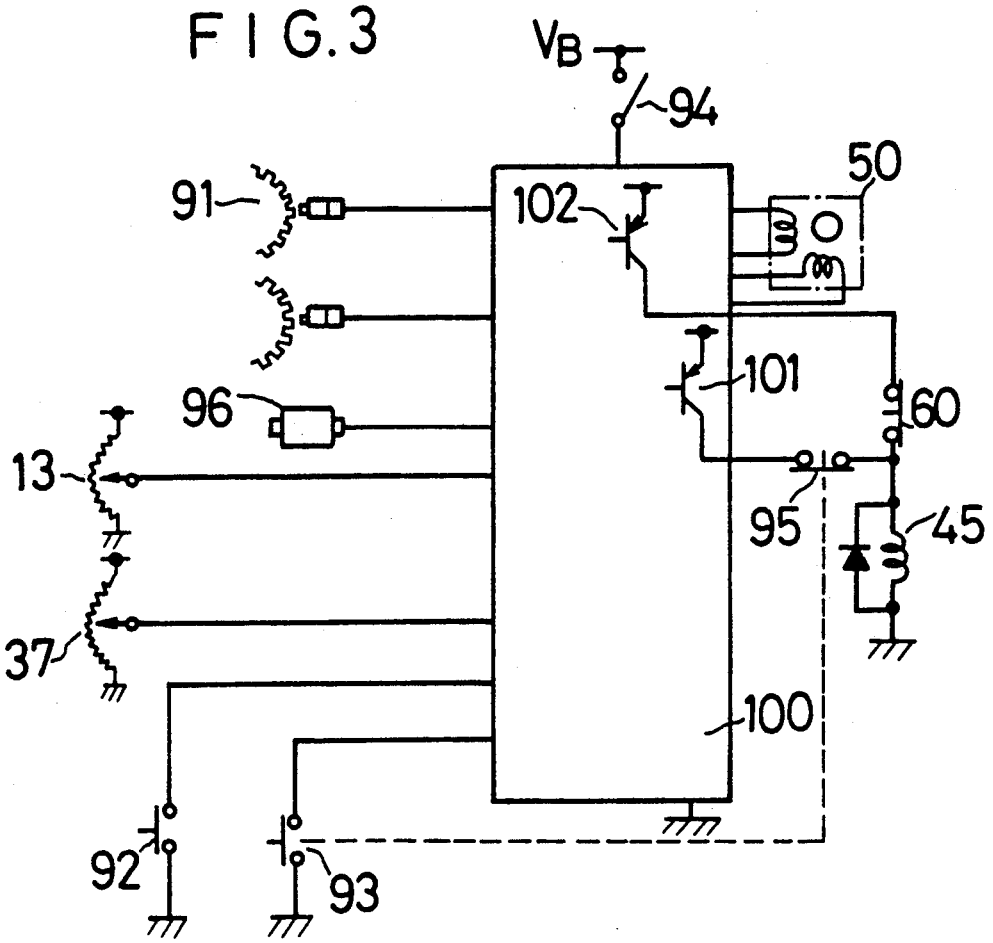
FIG. 3 shows the general arrangement of the controller section of the throttle control apparatus shown in FIG. 1.

The controller 100, which is a control circuit including a microcomputer, is mounted on the vehicle and supplied, as input signals, with detecting signals from various sensors, as shown in FIG. 3, thereby effecting various control operations including the drive control of the electromagnetic clutch mechanism 60 and the motor 50. In this embodiment, the controller 100 effects various control operations such as acceleration slip control, constant speed running control, etc. in addition to the control usually effected in response to the operation of the accelerator pedal 34.

Referring next to FIG. 3, the acceleration sensor 37 outputs a signal corresponding to the accelerator actuating quantity, that is, the amount to which the accelerator pedal 34 is depressed. The output signal from the acceleration sensor 37 is input to the controller 100 together with the output signal from the throttle sensor 13. In the controller 100, the drive control of the motor 50 is effected so that it is possible to obtain a preset degree of opening of the throttle valve 11 in accordance with the degree to which the accelerator pedal 34 is depressed.

Wheel speed sensors 91 are used for constant speed running control, acceleration slip control, etc. Each wheel speed sensor 91 may be a known electromagnetic pickup sensor, a Hall sensor, etc. Although two wheel speed sensors 91 are shown in FIG. 3, the sensors 91 may be attached to all the wheels, if necessary. Further, an engine speed sensor 96 is connected to the controller 100 to input thereto a signal representative of the number of revolutions of the internal combustion engine. In addition, a pair of set and cancel switches 92 and 93 for constant speed running control are connected to the controller 100 to input thereto either a set signal or a reset signal in response to the switching operation of these switches. It should be noted that the cancel switch 93 is coupled to a brake pedal (not shown) such that, when the brake pedal is actuated, the cancel switch 93 is automatically closed to input a signal to the controller 100.

A switching transistor 101 in the controller 100 controls the supply of electric power to the coil 45 in the electromagnetic clutch mechanism 40 during constant speed running to thereby control the drive of the electromagnetic clutch mechanism 40. The switching transistor 101, together with the cancel switch 93, is connected to the coil 45 through a brake switch 95 which opens and closes in response to the operation of the brake pedal. The coil 45 is connected to a power supply $V_B$ through the limit switch 60, the controller 100 and an ignition switch 94. It should be noted that the ignition switch 94 may be a transistor, a relay or another switching element which becomes conductive when the engine ignition switch is turned on. Another switching transistor 102 in the controller 100, which also controls the supply of electric power to the coil 45 in the electromagnetic clutch mechanism 40, is maintained in a conductive state when the throttle control apparatus is in a normal operative state.

The limit switch 60, as described above, has a fail-safe function. More specifically, when the accelerator pedal 34 is depressed less than a predetermined accelerator actuating degree, for example, when the accelerator plate 34 is in the position shown in FIG. 2 and the degree of accelerator actuation is approximately zero and, at the same time, the throttle valve 11 is opened in excess of a predetermined angle, that is, when the throttle plate 21 rotates clockwise as viewed in FIG. 2 in excess of a predetermined angle, the sliding member 63 comes into contact with the respective small radius portions of the throttle and accelerator plates 21 and 36, resulting in the opposing contacts of the reeds 61 and 62 separating from each other. Accordingly, the supply of power to the coil 45 is cut off unless the transistor 101 is in an on state in the constant speed running control mode (described later); therefore, there is no possibility of the throttle valve 11 being driven by the motor 50.

The operation of the embodiment having the foregoing arrangement will be explained for each control mode. When the accelerator pedal 34 is not actuated, that is, when the throttle valve 11 is fully closed, the throttle plate 21 and the accelerator plat 36 are disposed as shown in FIG. 2.

Figure 9:
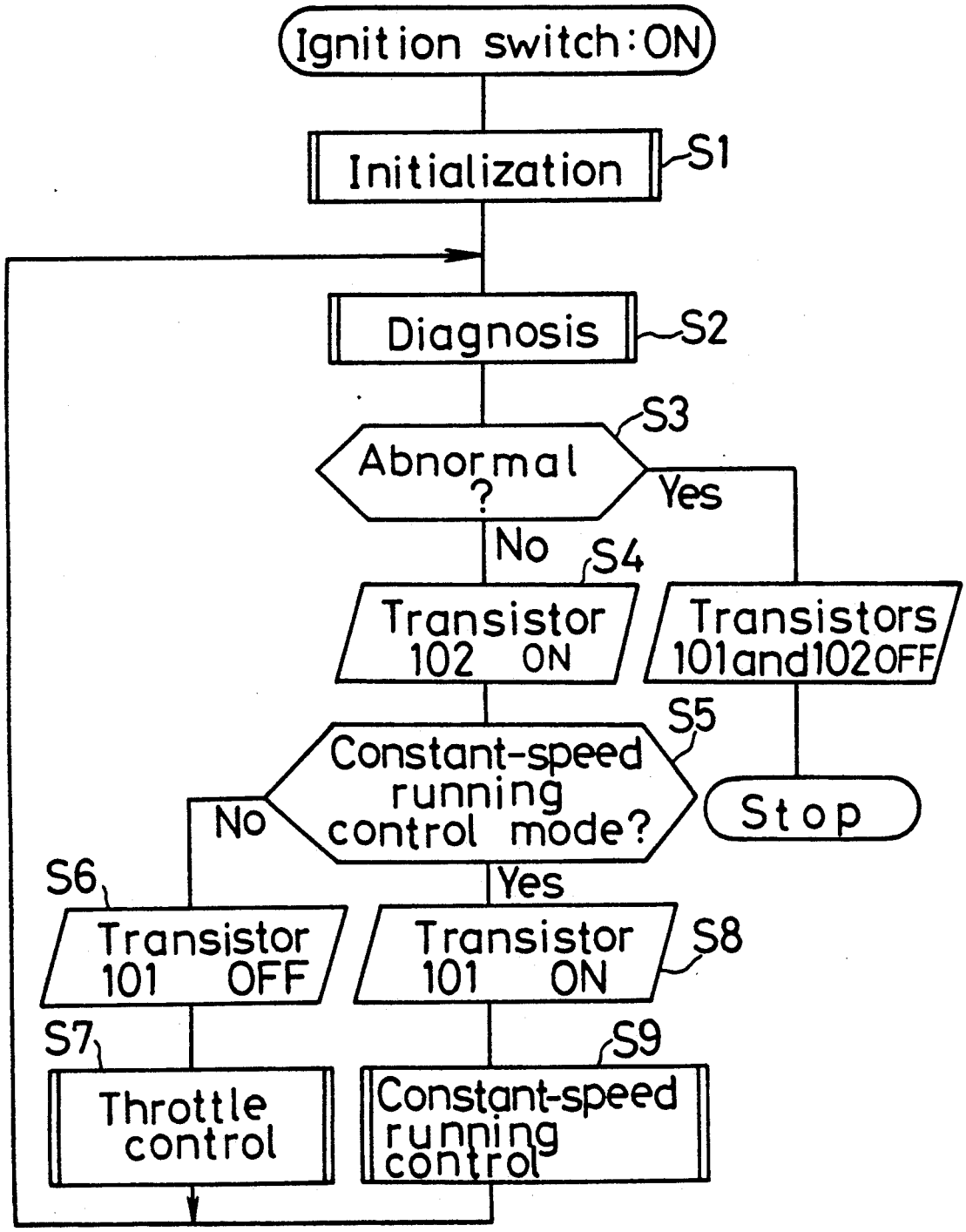
FIG. 9 is a flow chart showing the operation of the embodiment shown in FIG. 1.

First, when the ignition switch 94 is turned on, a self-diagnosis is conducted by the diagnostic means of the controller 100. If the control system is judged to be normal, the coil 45 of the electromagnetic clutch mechanism 40 is energized. That is, steps S1 to S4 in the flow chart shown in FIG. 9 are executed. Thus, the fixed and movable yokes 44 and 43 are energized to connect together the clutch plate 42 and the movable yoke 43, resulting in a state wherein the driving force from the motor 50 is transmitted to the throttle shaft 12. Thereafter, the throttle shaft 1 is driven to rotate by the motor 50 unless an abnormal situation (described later) occurs. Accordingly, the degree of opening of the throttle valve 11 is controlled by the motor 50 are determined by the controller 100.

Figure 4:
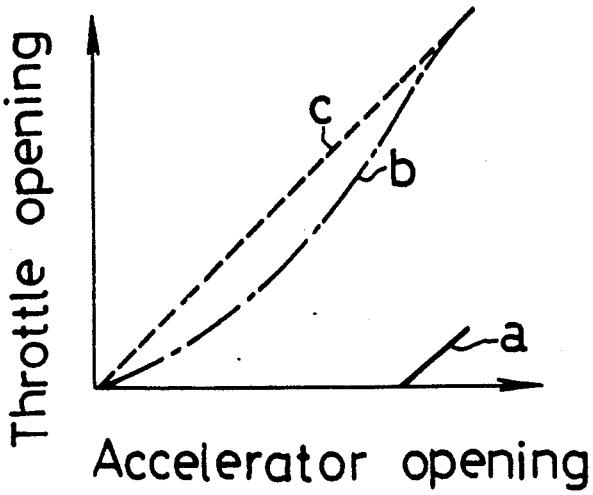
FIG. 4 is a graph showing the relationship between the accelerator opening and the throttle opening.

During normal running, when the accelerator pedal 34 is depressed, the accelerator link 31 is rotated in accordance with the degree of accelerator pedal actuation against the biasing force from the return springs 35*a* and 35*b*. In consequence, the accelerator plate 36 rotates clockwise as viewed in FIG. 2, thus maintaining the limit switch 60 in the closed position. In addition, the angle of rotation of the accelerator plate 36 that corresponds to the degree of accelerator pedal actuation is detected by the acceleration sensor 37 that is associated with the accelerator plate 36 through the engagement projection 36*c* shown in FIG. 1. The detecting output from the acceleration sensor 37 is input to the controller 100 where a predetermined throttle opening corresponding to the angle of rotation of the accelerator plate 36 is obtained. For example, a target throttle opening corresponding to the angle of rotation of the accelerator plate 36, that is, the accelerator opening, is set on the basis of the characteristics b or c shown in FIG. 4. When the motor 50 is driven to rotate the throttle shaft 12, a signal corresponding to the angle of rotation of the throttle shaft 12 is output from the throttle sensor 13 to the controller 100, and the drive of the motor 50 is controlled by the controller 100 so that the opening of the throttle valve 11 becomes approximately equal to the target throttle opening. Thus, throttle control is effected in accordance with the degree of accelerator pedal actuation to obtain an engine output corresponding to the degree of opening of the throttle valve 11.

It should be noted that, during the above-described operation of the throttle valve 11, the accelerator plate 36 and the throttle plate 21 are not engaged with each other and the accelerator plate 36 follows the rotation of the throttle plate 21 with a predetermined angle maintained therebetween. Accordingly, there is no mechanical interlocking relation occurring between the accelerator pedal 34 and the throttle valve 11 and it is possible to ensure smooth start and running in response to the operation of the accelerator pedal 34. When the accelerator pedal 34 is released, the accelerator link 31 is returned to the initial position by means of the biasing force from the return springs 35*a* and 35*b* and the throttle valve 11 is also brought to the fully closed position.

The following is a description of the operation of the throttle control apparatus according to the embodiment in the acceleration slip control mode. If slip of a driving wheel (not shown) is detected at the time of starting or accelerating the vehicle on the basis of the output signals from the wheel speed sensors 91, the control mode is shifted from the above-described normal running mode to the acceleration slip control mode to control the degree of opening of the throttle valve 11.

More specifically, the controller 100 computes a slip factor of the driving wheel with which adequate tractive force and resistance to side slip are obtained on the particular road surface and further computes a target throttle opening required to ensure the computed slip factor. Then, the motor 50 is controlled so that the degree of opening of the throttle valve 11 is coincident with the target throttle opening. When the slip factor becomes lower than a predetermined value and the target throttle opening becomes higher than a set throttle opening in the normal running mode shown in FIG. 4, the acceleration slip control mode is completed and the control mode returns to the normal running mode. Since the degree of opening of the throttle valve 11 is continuously controlled by the motor 50 even during the shift of the control mode, no so-called pedal shock acts on the accelerator pedal 34 during the shift of the control mode from the acceleration slip control mode to the normal running mode.

The operation of the throttle control apparatus in the constant-speed running control mode will next be explained. Referring to FIG. 3, when the driver actuates the set switch 92 for the constant-speed running, the switching transistor 101 in the controller 100 turns on to complete a circuit for supplying electric power to the coil 45 in the electromagnetic clutch mechanism 40 via the normally-closed brake switch 95. More specifically, the control process proceeds to Steps S5, S8 and S9 in the flowchart shown in FIG. 9. Consequently, even if the accelerator pedal 34 is released to stop the accelerator actuation and, hence, the accelerator plate 36 is returned to the initial position, the supply of electric power to the coil 45 is continued and therefore the throttle shaft 12 is connected to the motor 50 through the electromagnetic clutch mechanism 40. Thus, a target throttle opening is set on the basis of the difference between the vehicle speed detected by the wheel speed sensors 91 and the vehicle speed set through the set switch 92, and the throttle valve 11 is controlled to the target throttle opening by the operation of the motor 50.

If the accelerator pedal 34 is depressed due to the necessity for acceleration during the constant-speed running and consequently the throttle opening corresponding to the amount of accelerator pedal actuation in the normal running mode exceeds the target throttle opening set in the constant-speed running, the control mode is shifted to the override mode, in which the target throttle opening is replaced by the set opening in the normal running mode.

To suspend the constant-speed running, the driver actuates the cancel switch 93 or actuates the brake pedal to operate the cancel switch 93. In consequence, the transistor 101 turns on to carry out the aforementioned throttle control in the normal running mode. That is, Steps S6 and S7 in the flowchart shown in FIG. 9 are executed. It should be noted that, if the switching transistor 101 in the controller 100 should short-circuit during the constant-speed running control, the brake switch 95 is turned off by actuating the brake pedal. Therefore, the coil 45 in the electromagnetic clutch mechanism 40 is not energized and the movable yoke 43 and the clutch plate 42 are positively separated from each other, so that the throttle valve 11 is returned to the closed position by means of the biasing force from the return springs 22*a* and 22*b*.

When the degree of opening of the throttle valve 11 and the actuating quantity of the accelerator pedal 34 are detected as being lower than respective predetermined values by the throttle sensor 13 and the acceleration sensor 37, the control mode is shifted to the idling control mode, in which the motor 50 is controlled so that the engine speed coincides with a target engine speed which is set in accordance with engine running conditions, for example, the cooling water temperature, load, etc., at that time. Accordingly, the limit switch 60 is set so as not to turn off in such a situation, as shown in FIG. 2.

It should be noted that, when the engine speed that is detected by the engine speed sensor 96 exceeds a predetermined value, the control mode is shifted to the engine speed limiting mode, in which the degree of opening of the throttle valve 11 is controlled to a predetermined target throttle opening. When the vehicle speed exceeds a predetermined vehicle speed, the control mode is shifted to the automatic vehicle speed limiting mode, in which the degree of opening of the throttle valve 11 is controlled to a predetermined target throttle opening.

In the foregoing throttle control apparatus, if the controller 100 should malfunction due to an electrical problems or the like such as to cause the throttle valve 11 to rotate in the opening direction independently of the operation of the accelerator pedal 34, the throttle valve 11 is returned to the closed position by bringing the accelerator pedal 34 into an inoperative state. More specifically, when the movable yoke 43 that is integral with the throttle valve 11 is driven to rotate the throttle plate 21 clockwise as viewed in FIG. 2, the small-radius portion of the disc portion 21*a* of the throttle plate 21 comes to face the sliding member 63 of the limit switch 60. If, in this state, the accelerator pedal 34 is moved to an inoperative state, the accelerator plate 36 returns to the initial position shown in FIG. 2 and the small-radius portion of the disc portion 36*a* comes to face the sliding member 63 of the limit switch 60. Thus, the sliding member 63 comes into contact with the respective small-radius portions of the disc portions 21*a* and 36*a*. Thus, the contact of the reed 61 is separated from the contact of the reed 62 to turn off the limit switch 60 and bring the electromagnetic clutch mechanism 40 into a non-energized state. Thus, if an abnormal operation of the throttle valve 11 occurs, the throttle valve 11 is returned to the closed position to lower the engine output by releasing the accelerator pedal 34.

Further, even if the motor 50 or the controller 100 in this embodiment should become inoperative, the arm portion 36*b* of the accelerator plate 36 is pivotally moved to engage with the pin 23 of the throttle plate 21 by depressing the accelerator pedal 34 more than a predetermined quantity, as will be clear from FIGS. 1 and 2. Thus, the movable yoke 43 is driven in the direction in which the throttle valve 11 is opened to ensure a predetermined degree of opening, as shown by the characteristic curve a in FIG. 4. Therefore, the driver can continue driving the vehicle, although the vehicle speed is relatively low.

Figure 5A:
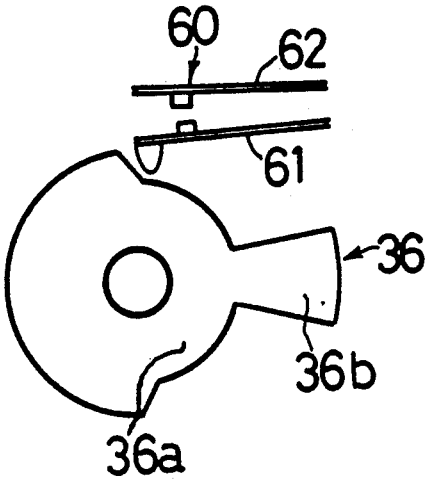
FIGS. 5(*a*) and 5(*b*) are schematic views showing the operation of the combination of the limit switch and the accelerator plate, in which FIG. 5 (*a*) shows the combination when the accelerator plate is in the initial position and FIG. 5 (*b*) shows the combination when the accelerator plate is driven to rotate.
Figure 5B:
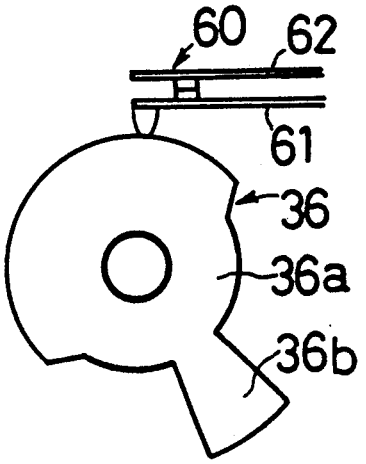
Figure 6A:
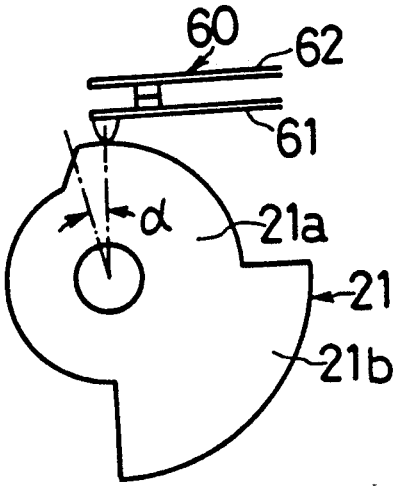
FIGS. 6(*a*) and 6(*b*) are schematic views showing the operation of the combination of the limit switch and the throttle plate, in which FIG. 6 (*a*) shows the combination when the throttle plate is in the initial position and FIG. 6 (*b*) shows the combination when the throttle plate is driven to rotate.
Figure 6B:
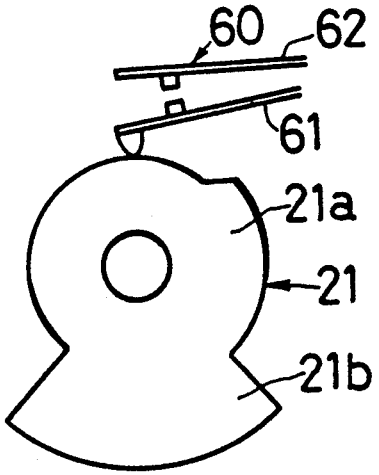

The operation of the limit switch 60 in the foregoing embodiment will next be described in detail with reference to FIGS. 5 and 6. FIG. 5 schematically shows the relationship between the accelerator plate 36 and the limit switch 60, while FIG. 6 schematically shows the relationship between the throttle plate 21 and the limit switch 60. FIG. 5(*a*) shows the initial state wherein the accelerator pedal 34 shown in FIG. 1 is not actuated. In this state, the sliding member 63 of the limit switch 60 faces the small-radius portion of the disc portion 36*a* of the accelerator plate 36 and is pressed so as to contact the outer peripheral surface of the small-radius portion by the biasing force from the reed 61. Accordingly, the opposing contacts of the reeds 61 and 62 are separate from each other.

When the accelerator pedal 34 is actuated, the accelerator plate 36 rotates clockwise, so that the sliding member 63 comes into contact with the outer peripheral surface of the large-radius portion of the disc portion 36*a*, as shown in FIG. 5(*b*). More specifically, the opposing contacts of the reeds 61 and 62 come into contact with each other to make contact between the reeds 61 and 62, thus enabling the coil 45 of the electromagnetic clutch mechanism 40 to be energized.

FIG. 6(*a*) shows the state wherein the throttle plate 21, which is biased by the return springs 22*a* and 22*b*, is in the initial position. In this state, the throttle valve 11 shown in FIG. 1 is in the closed position. The sliding member 63 of the limit switch 60 is in contact with the large-radius portion of the disc portion 21*a* of the throttle plate 21 and the opposing contacts of the reeds 61 and 62 are in contact with each other to make contact between the reeds 61 and 62, thus enabling the coil 45 of the electromagnetic clutch mechanism 40 to be energized.

When the movable yoke 43 of the electromagnetic clutch mechanism 40 is driven to rotate in excess of a predetermined angle by the motor 50 through the clutch plate 42, the limit switch 60 is brought into the state shown in FIG. 6(*b*). More specifically, when the throttle plate 21 is driven to rotate in excess of a predetermined angle $\alpha$, the sliding member 63 of the limit switch 60 comes into contact with the small-radius portion of the disc portion 21*a* of the throttle plate 21 and the reed 61 separates from the reed 62 to open the opposing contacts, thus bringing the coil 45 of the electromagnetic clutch mechanism 40 into a non-energized state.

Since the sliding member 63 of the limit switch 60 is disposed so as to face the respective outer peripheral surfaces of the throttle and accelerator plates 21 and 36, as shown in FIG. 1, the reed 61 operates in accordance with the correlation between these plates 21 and 36 and therefore it separates from the reed 62 to open the opposing contacts when the situations that are shown in FIGS. 5(*a*) and 6(*b*) occur at the same time. More specifically, the reed 61 separates from the reed 62 to open the contacts when the degree of actuation of the accelerator pedal 34 is not greater than a predetermined degree of actuation and the throttle plate 21 is driven to rotate in excess of a predetermined angle $\alpha$. Except for this situation, the opposing contacts of the two reeds 61 and 62 are in contact with each other.

Thus, when the throttle valve 11 operates abnormally, if the accelerator pedal 34 is released from the operative state, the accelerator plate 36 is returned to the initial position by the action of the return springs 35*a* and 35*b*, resulting in the condition shown in FIGS. 5(*a*) and 6(*b*). When the limit switch 60 turns off in this way, the supply of power to the coil 45 is cut off, as will be clear from FIG. 3, and the movable yoke 43 of the electromagnetic clutch mechanism 40 is separated from the clutch plate 42. Accordingly, movement of the throttle valve 11 by the driving plate 41 is suspended, and the throttle valve 11 is returned to the initial position by the action of the return springs 22*a* and 22*b*.

Figure 7:
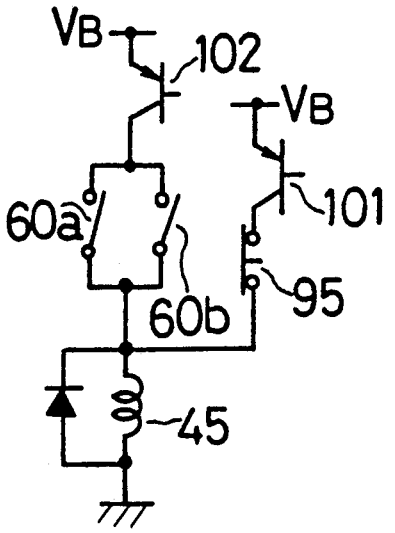
FIG. 7 is an electric circuit diagram showing another embodiment in which the limit switch employed in the embodiment shown in FIGS. 1 and 2 constitutes each of the first and second detecting means.

In the foregoing embodiment, the limit switch 60 comprises a single reed switch and the sliding member 63 is disposed so as to face the respective outer peripheries of the throttle and accelerator plates 21 and 36. It is also possible to provide two reed switches 60*a* and 60*b* so as to face the throttle and accelerator plates 21 and 36, respectively, and connect these reed switches in parallel as shown in FIG. 7. Such an arrangement also provides the same function as the above. Although in the foregoing embodiment the limit switch 60 is accommodated inside the casing 2 attached to the throttle body 1, the reed switch for detecting the degree of accelerator actuation may be attached to the cover 3 outside the casing 2. It is also possible to provide a sensor which directly detects the degree or amount of accelerator pedal actuation.

Figure 8:
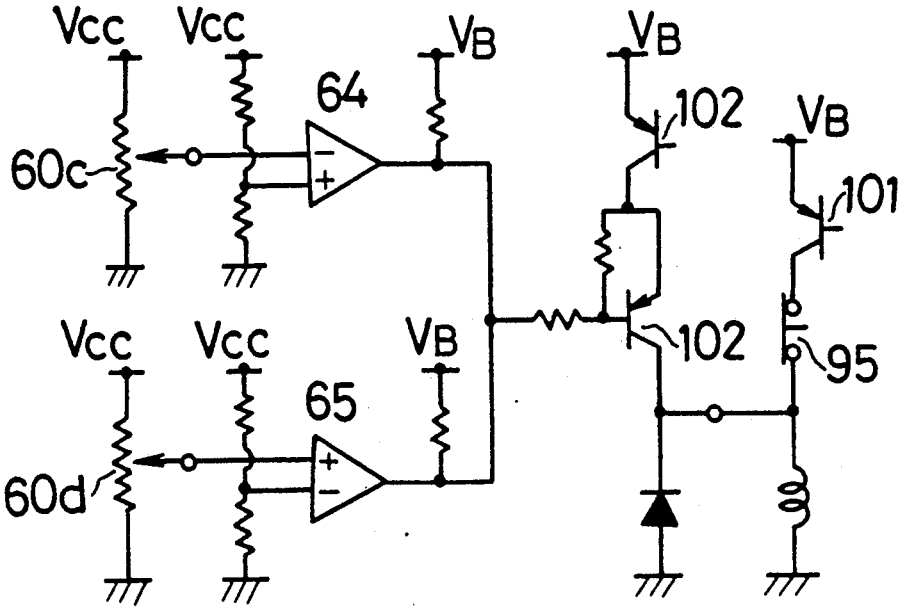
FIG. 8 is an electric circuit diagram showing still another embodiment in which analog sensors are employed to constitute first and second detecting means.

The arrangement may also be such that analog sensors 60*c* and 60*d*, for example, potentiometers, are employed in place of the reed switches 60*a* and 60*b* shown in FIG. 7. The analog sensors are connected to respective comparators 64 and 65, as shown in FIG. 8, so that, when the output of either analog sensor reaches a predetermined low level, the transistor 102, serving as a switching means, is turned on. Such an arrangement also provides the same function as the above. It is also possible to utilize the acceleration sensor 37 and the throttle sensor 13 as the analog sensors 60*c* and 60*d*, respectively. It should be noted that in FIGS. 7 and 8 the same reference numerals as those in FIG. 3 denote the same elements. Further, the limit switch 60 may comprise the combination of a light detector, for example, a photointerrupter, and a switching element. It is also possible to form a redundant system by combining together the reed switch 60 and the reed switches 60*a*, 60*b* or the analog sensors 60*c*, 60*d*, for example.

The present invention arranged as described above provides the following advantages.

According to the throttle control apparatus of the present invention, during normal running the throttle opening and closing means and the driving means are connected through the clutch means, thereby enabling the degree of opening of the throttle valve to be controlled by the driving means independently of the accelerator actuating mechanism. It is therefore possible to ensure smooth start and running in response to the operation of the accelerator and it is also possible to readily effect various control operations such as acceleration, slip control, constant-speed running control, etc.

Even if the driving means should abnormally operate in the throttle valve opening direction, the clutch means is activated through the first and second detecting means and the control means by such a simple and reliable method that the accelerator actuating mechanism is brought into an inoperative state. Therefore, it is possible to positively separate the driving means from the throttle opening and closing means.

Further, in the throttle control apparatus having a second driving means, the driving means and the throttle opening and closing means are separated from each other by the clutch means when an abnormal operation of the driving source occurs. In such a case, however, a predetermined throttle opening can be ensured by the accelerator actuating mechanism through the second driving means and it is therefore possible to drive the vehicle to a mechanic for repairs.

Although the present invention has been described through specific terms, it should be noted that the described embodiments are not necessarily exclusive and that various changes and modifications may be imparted thereto without departing from the scope of the invention which is limited solely by the appended claims.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A throttle control apparatus having throttle opening and closing means for opening and closing a throttle valve, biasing means for biasing said throttle opening and closing means in the throttle valve closing direction, an accelerator actuating mechanism, driving means for driving said throttle opening and closing means in the throttle valve opening and closing directions independently of said accelerator actuating mechanism, a driving source coupled to said driving means to drive said driving means in response to operation of said accelerator actuating mechanism, and clutch means for connecting and disconnecting said throttle opening and closing means and said driving means, wherein the improvement comprises:

first detecting means for outputting a signal corresponding to a degree of accelerator actuation provided by said accelerator actuating mechanism;

second detecting means for outputting a signal corresponding to a degree of opening of said throttle valve; and control means for driving said clutch means to disconnect said throttle opening and closing means and said driving means from each other when the output signal from said first detecting means indicates a degree of accelerator actuation not greater than a predetermined degree of accelerator actuation and the output signal from said second detecting means is a predetermined angle greater than the degree of opening of said throttle valve corresponding to the degree of accelerator actuation not greater than the predetermined degree of accelerator actuation.

2. A throttle control apparatus according to claim 1, further comprising a second driving means disposed so as to be engagable with said throttle opening and closing means in the throttle valve opening direction and coupled to said accelerator actuating mechanism to drive said throttle opening and closing means to rotate in response to the accelerator actuating operation, said second driving means rotating independently of said driving means.

3. A throttle control apparatus according to claim 2, wherein said first detecting means outputs a signal corresponding to the angle of rotation of said second driving means.

4. A throttle control apparatus according to claim 1, wherein said clutch means comprises an electromagnetic clutch mechanism and each of said first and second detecting means includes a limit switch controlling the supply of electric power to said electromagnetic mechanism in response to the operation of said limit switch.

5. A throttle control apparatus according to claim 1, wherein said clutch means comprises an electromagnetic clutch mechanism, said first and second detecting means comprises analog sensors, and said apparatus further comprises switching means for controlling electric power to said electromagnetic clutch mechanism in response to signals from said analog sensors.

* * * * *